US007468482B2

(12) United States Patent
Gouhara et al.

(10) Patent No.: US 7,468,482 B2
(45) Date of Patent: Dec. 23, 2008

(54) PIANO SOUND SOURCE APPARATUS, METHOD AND PROGRAM FOR PIANO SOUND SYNTHESIS

(75) Inventors: Takayuki Gouhara, Tokyo (JP); Shinichi Komori, Kanagawa (JP); Tomoe Ando, Kanagawa (JP)

(73) Assignee: Sony Corporation, Tokyo (JP)

( * ) Notice: Subject to any disclaimer, the term of this patent is extended or adjusted under 35 U.S.C. 154(b) by 19 days.

(21) Appl. No.: 11/765,558

(22) Filed: Jun. 20, 2007

(65) Prior Publication Data

US 2008/0011150 A1 Jan. 17, 2008

(30) Foreign Application Priority Data

Jun. 23, 2006 (JP) ..... 2006-174206

(51) Int. Cl.
*G10H 5/00* (2006.01)

(52) U.S. Cl. ..... 84/671; 84/672; 84/678; 84/687; 84/691; 84/697

(58) Field of Classification Search ..... None
See application file for complete search history.

(56) References Cited

U.S. PATENT DOCUMENTS 5,936,182 A * 8/1999 Izumisawa ..... 84/623

FOREIGN PATENT DOCUMENTS

JP 10-247084 9/1998

* cited by examiner

*Primary Examiner*—Marlon T Fletcher
(74) *Attorney, Agent, or Firm*—Finnegan, Henderson, Farabow, Garrett & Dunner, L.L.P.

(57) ABSTRACT

Disclosed is a piano sound source apparatus for adding a piano sound source providing a plurality of sinusoidal oscillation frequencies and a noise source providing a plurality of noise oscillation frequencies to output a composite tone. The apparatus includes an oscillation control unit that controls the frequency and amplitude of each of sine waves corresponding to the sinusoidal oscillation frequencies on the basis of time, an amplitude control unit that controls the amplitude of each of the sine waves corresponding to the sinusoidal oscillation frequencies in accordance with the intensity of the composite tone, and a mixing-proportion control unit that controls the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

9 Claims, 8 Drawing Sheets

EXAMPLE OF VALUES IN FIRST ATTENUATION TABLE

EXAMPLE OF VALUES IN
SECOND ATTENUATION TABLE

FIG. 5A

FIRST TABLE
(OSCILLATOR CONTROL TABLE)

51 52 53 54

| OSCILLATOR NUMBER | USAGE | NOTE | LATEST AMPLITUDE |
|---|---|---|---|
| 1 | IN USE | C4 | −20 dB |
| 2 | IN USE | C4 | −25 dB |
| 3 | IN USE | A2 | −80 dB |
| M | NOT IN USE | — | — |

FIG. 5B

SECOND TABLE
(NOTE CONTROL TABLE)

55 56

| NOTE | DURATION |
|---|---|
| C0 | — |
| C#0 | — |
| A2 | 3.1 SEC. |
| C4 | 0.5 SEC. |
| C#4 | — |
| B7 | — |
| C8 | — |

FIG. 6A

THIRD TABLE
(HARMONIC AMPLITUDE TABLE)

| 61 NOTE | 62 ORDINAL NUMBER OF HARMONIC | 63 MAXIMUM AMPLITUDE |
|---|---|---|
| C0 | 1 | −6 dB |
| C0 | 2 | −0 dB |
| ⋮ | | |
| C4 | 1 | −0 dB |
| C4 | 2 | −3 dB |
| C4 | 3 | −8 dB |
| C4 | 4 | −12 dB |
| ⋮ | | |
| C8 | 1 | −0 dB |
| C8 | 2 | −3 dB |
| C8 | 3 | −8 dB |

FIG. 6B

FOURTH TABLE
(HARMONIC INTENSITY TABLE)

| 64 NOTE | 65 ORDINAL NUMBER OF HARMONIC | 66 INTENSITY | 67 ATTENUATION |
|---|---|---|---|
| C0 | 1 | 100 | 0 dB |
| C0 | 1 | 99 | −0.1 dB |
| ⋮ | | | |
| C4 | 1 | 100 | 0 dB |
| C4 | 1 | 99 | −0.15 dB |
| C4 | 1 | 98 | −0.3 dB |
| ⋮ | | | |
| C4 | 50 | 100 | 0 dB |
| C4 | 50 | 99 | −1 dB |
| C4 | 50 | 98 | −2 dB |
| ⋮ | | | |
| C8 | 3 | 3 | −89 dB |
| C8 | 3 | 2 | −90 dB |
| C8 | 3 | 1 | −91 dB |

FIG. 6C

FIFTH TABLE
(INTENSITY TO ATTENUATION CONVERSION TABLE)

| 68 INTENSITY | 69 ATTENUATION |
|---|---|
| 100 | 0 dB |
| 99 | −1 dB |
| ⋮ | |
| 2 | −59 dB |
| 1 | −60 dB |

PIANO SOUND SOURCE APPARATUS, METHOD AND PROGRAM FOR PIANO SOUND SYNTHESIS

CROSS REFERENCES TO RELATED APPLICATIONS

The present invention contains subject matter related to Japanese Patent Application JP 2006-174206 filed in the Japanese Patent Office on Jun. 23, 2006, the entire contents of which are incorporated herein by reference.

BACKGROUND OF THE INVENTION

1. Field of the Invention

The present invention relates to a piano sound source apparatus for outputting a composite tone using a piano sound source providing a plurality of sinusoidal oscillation frequencies and a method and program for piano sound synthesis.

2. Description of the Related Art

FIG. 8 shows a known piano sound source apparatus. Referring to FIG. 8, in the known piano sound source apparatus, an oscillator 82-1 generates a sine wave corresponding to a fundamental tone using data 81-1 regarding frequency, amplitude, and time variation. In addition, an oscillator 82-N generates a sine wave corresponding to an Nth harmonic using data 81-N regarding frequency, amplitude, and time variation. Further, a noise generator 83 generates a signal corresponding to noise.

An adder 84 adds sine waves, corresponding to the fundamental tone and respective harmonics up to the Nth harmonic, generated by the oscillators 82-1 and 82-N and the signal, corresponding to the noise, generated by the noise generator 83 and outputs the resultant tone as a composite tone. In other words, the adder 84 outputs the composite tone obtained by adding all of the sine waves of the fundamental tone and the respective harmonics up to the Nth harmonic and the noise.

Further, a low-pass filter 86 changes its cut-off frequency in accordance with data 85 about the intensity of a musical performance tone and passes the composite tone obtained by adding all of the sine wave of the fundamental tone and the respective harmonics up to the Nth harmonic and the noise. After that, an attenuator 87 controls the amplitude of the composite tone in accordance with the data 85 and outputs the resultant tone as a composite tone 88.

The above-described cut-off frequency control and attenuation on the composite tone according to the intensity of the tone are based on the fact that general piano tones have such properties that high-order harmonics and noise are reduced when the intensity of a musical performance tone is low.

Japanese Unexamined Patent Application Publication No. 10-247084 discloses a sound source apparatus for slightly changing a timbre according to timbre control information generated on the basis of a key touch and other factors. The apparatus includes an arithmetic unit in each of oscillators similar to the above-described oscillators 82-1 to 82-N. In the apparatus, a band waveform signal is generated on the basis of frequency data and the result of calculation obtained using a coefficient by each arithmetic unit, the coefficient being determined according to two or more timbre control parameters for control of a timbre.

SUMMARY OF THE INVENTION

In the foregoing method of performing cut-off frequency control and attenuation on a composite tone, obtained by adding all of sine waves of the fundamental tone and the respective harmonics up to the Nth harmonic and noise, the cut-off frequency control and attenuation based on the intensity of a tone are uniformly performed on each composite tone obtained from all of the sine waves. Unfortunately, when an attenuation is too much to produce a soft tone, a sense of piano tone may be lost, the articulation of the tone may be reduced, and/or the vertical upper limit of a sound image representing an audible range may be shifted farther away.

The above-described known piano sound source apparatus utilized the following method: The number N of oscillators 82-1 and 82-N necessary for generation of one composite tone using a plurality of sine waves is predetermined. When the N oscillators are not usable upon reception of a tone generation request, an oscillator oscillating at the frequency of a tone having a longer duration among already generated tones is stopped. The stopped oscillator is allowed to oscillate at another frequency and is used for generation of a new tone.

Disadvantageously, this method has high potential to stop oscillation of an oscillator unnecessary to be used. This leads to interruption of a tone which is being generated. Unfortunately, a sense of incongruity in musical performance is caused.

It is desirable to provide a piano sound source apparatus capable of appropriately performing signal processing in accordance with the intensity (softness or loudness) of a tone and further allowing the necessary number of oscillators to be usable in accordance with their usages, and a method and program for piano sound synthesis.

According to an embodiment of the present invention, a piano sound source apparatus includes an oscillation control unit that controls the frequency and amplitude of each of sine waves corresponding to a plurality of sinusoidal oscillation frequencies on the basis of time, an amplitude control unit that controls the amplitude of each of the sine waves corresponding to the sinusoidal oscillation frequencies in accordance with the intensity of a composite tone, and a mixing-proportion control unit that controls the amplitude of each of a plurality of noise oscillation frequencies in accordance with the intensity of the composite tone to control the mixing proportion of the amplitudes of the noise oscillation frequencies and those of the sine waves corresponding to the sinusoidal oscillation frequencies.

In this apparatus, therefore, the oscillation control unit controls the frequency and amplitude of each of the sine waves corresponding to the sinusoidal oscillation frequencies on the basis of time. The amplitude control unit controls the amplitude of each of the sine waves corresponding to the sinusoidal oscillation frequencies in accordance with the intensity of the composite tone. The mixing-proportion control unit controls the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

According to another embodiment of the present invention, a piano sound synthesis method includes the steps of controlling the frequency and amplitude of each of sine waves corresponding to a plurality of sinusoidal oscillation frequencies on the basis of time, controlling the amplitude of each of the sine waves corresponding to the sinusoidal oscillation frequencies according to the intensity of a composite tone, and controlling the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

According to this method, the frequency and amplitude of each of the sine waves corresponding to the sinusoidal oscillation frequencies are controlled on the basis of time. The amplitude of each of the sine waves corresponding to the sinusoidal oscillation frequencies is controlled in accordance with the intensity of the composite tone. The amplitude of each of the noise oscillation frequencies is controlled in accordance with the intensity of the composite tone to control the mixing proportion of the amplitudes of the noise oscillation frequencies and those of the sine waves corresponding to the sinusoidal oscillation frequencies.

According to further another embodiment of the present invention, a piano sound synthesis program includes an oscillation control function of controlling the frequency and amplitude of each of sine waves corresponding to a plurality of sinusoidal oscillation frequencies on the basis of time, an amplitude control function of controlling the amplitude of each of the sine waves corresponding to the sinusoidal oscillation frequencies in accordance with the intensity of a composite tone, and a mixing-proportion control function of controlling the amplitude of each of a plurality of noise oscillation frequencies in accordance with the intensity of the composite tone to control the mixing proportion of the amplitudes of the noise oscillation frequencies and those of the sine waves corresponding to the sinusoidal oscillation frequencies.

According to this program, the oscillation control function controls the frequency and amplitude of each of the sine waves corresponding to the sinusoidal oscillation frequencies on the basis of time. The amplitude control function controls the amplitude of each of the sine waves corresponding to the sinusoidal oscillation frequencies in accordance with the intensity of the composite tone. The mixing-proportion control function controls the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

According to each of the embodiments of the present invention, a change in amplitude of each of harmonics included in each note against the intensity of the note is reproduced using data obtained from real piano tones. Advantageously, a composite tone that changes in accordance with the intensity of the tone can be generated, the change being closer to that of a real piano tone.

According to each of the embodiments of the present invention, since many sine wave oscillators are not needed, cost can be reduced. Advantageously, a reduction in quality of a composite tone can be minimized while a predetermined number of oscillators are effectively utilized.

BRIEF DESCRIPTION OF THE DRAWINGS

FIGS. 5A and 5B show examples of control tables, FIG. 5A illustrating a first table, serving as an oscillator control table, FIG. 5B illustrating a second table, serving as a note control table;

FIGS. 6A to 6C show examples of control tables, FIG. 6A illustrating a third table, serving as a harmonic amplitude table, FIG. 6B illustrating a fourth table, serving as a harmonic intensity table, FIG. 6C illustrating an intensity to attenuation conversion table;

DESCRIPTION OF THE PREFERRED EMBODIMENT

An embodiment of the present invention will now be described with reference to the drawings.

Figure 1:
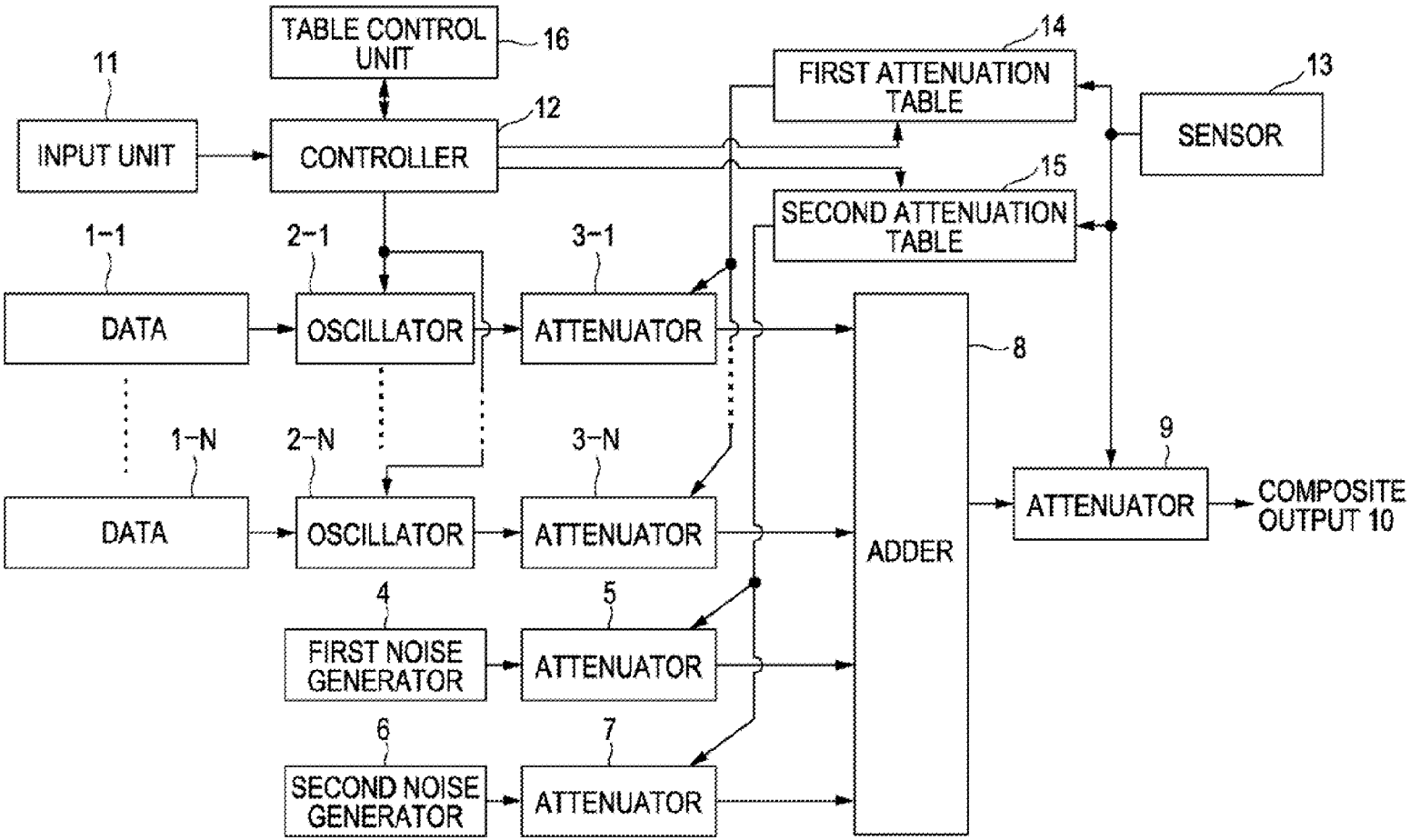
FIG. 1 is a block diagram of a piano sound source apparatus according to an embodiment of the present invention.

FIG. 1 is a block diagram of the structure of a piano sound source apparatus according to an embodiment of the present invention.

Referring to FIG. 1, in the piano sound source apparatus, an oscillator 2-1 generates a sine wave corresponding to a fundamental tone using data 1-1 regarding frequency, amplitude, and time variation and an oscillator 2-N generates a sine wave corresponding to an Nth harmonic using data 1-N regarding frequency, amplitude, and time variation.

An attenuator 3-1 attenuates the amplitude of the sine wave, corresponding to the fundamental tone, generated by the oscillator 2-1 on the basis of a predetermined characteristic of the fundamental tone. An attenuator 3-N attenuates the amplitude of the sine wave, corresponding to the Nth harmonic, generated by the oscillator 2-N on the basis of a predetermined characteristic of the Nth harmonic. Predetermined characteristics of the fundamental tone to the Nth harmonic used in the attenuators 3-1 to 3-N are stored in a first attenuation table 14. Each predetermined characteristic is a change in attenuation according to data indicating the intensity of a composite tone detected by a sensor 13. The predetermined characteristics are generated on the basis of data extracted from real piano tones.

A first noise generator 4 generates a signal corresponding to noise A, which includes up to a high frequency generated by a loud musical performance. A second noise generator 6 generates a signal corresponding to noise B, which does not include a high frequency generated by a soft musical performance. An attenuator 5 attenuates the amplitude of the signal corresponding to the noise A generated by the first noise generator 4 on the basis of a predetermined characteristic of the noise A.

An attenuator 7 attenuates the amplitude of the signal corresponding to the noise B generated by the second noise generator 6 on the basis of a predetermined characteristic of the noise B. The predetermined characteristics of the noises A and B are stored in a second attenuation table 15. Each of the predetermined characteristics of the noises A and B is a change in attenuation according to data indicating the intensity of a composite tone detected by the sensor 13. The predetermined characteristics are generated on the basis of data extracted from real piano tones.

An adder 8 adds the sine waves, respectively corresponding to the fundamental tone to the Nth harmonic, attenuated by the attenuators 3-1 to 3-N and the signals, respectively corresponding to the noises A and B, attenuated by the attenuators 5 and 7 and outputs the resultant tone as a composite tone. An attenuator 9 attenuates the composite tone so that the loudness level of the composite tone reaches the final level according to data indicating the intensity of the composite tone detected by the sensor 13.

Consequently, the attenuator 9 outputs a composite tone 10 obtained by adding all of the sine waves of the fundamental tone to the Nth harmonic and the signals corresponding to the noises A and B.

A controller 12 controls the start and stop of the oscillating operation of each of the oscillators 2-1 to 2-N in accordance with a note, serving as an input signal from an input unit 11 including keys and pedals.

The operation of the piano sound source apparatus with the above-described structure will now be described. The following operation is performed in accordance with a piano sound synthesis program that allows a computer, serving as the controller 12, to add a piano sound source providing a plurality of sinusoidal oscillation frequencies generated by the oscillators 2-1 to 2-N and a noise sound source providing a plurality of noise oscillation frequencies generated by the first and second noise generators 4 and 6 to output a composite tone.

Referring to FIG. 1, when receiving an input signal from the input unit 11, such as a key or a pedal, the controller 12 controls the oscillators 2-1 to 2-N to start the oscillating operation according to a note corresponding to the input signal.

As for sine waves, the oscillator 2-1 generates a sine wave corresponding to a fundamental tone and the oscillator 2-N generates a sine wave corresponding to an Nth harmonic under the control of the controller 12. The frequencies and amplitudes of the sine waves generated by the oscillators 2-1 to 2-N are controlled based on predetermined time variation data in the same way as the known apparatus. Outputs of the oscillators 2-1 to 2-N are supplied to the individually controlled attenuators 3-1 to 3-N, respectively.

Figure 2:
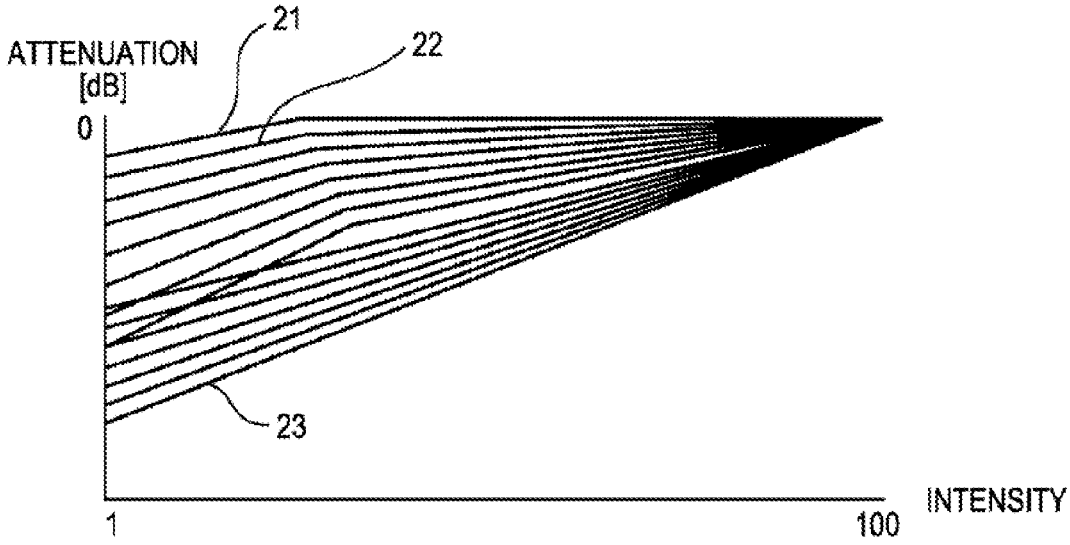
FIG. 2 is a graph showing an example of values in a first attenuation table.

FIG. 2 shows an example of values in the first attenuation table 14.

The attenuations of the attenuators 3-1 to 3-N are stored in the first attenuation table 14 such that the value of attenuation plotted on the ordinate is determined by the intensity plotted on the abscissa as shown in FIG. 2, the intensity being within the range of 1 to 100. This table describes attenuations of a fundamental tone 21, a second harmonic 22, . . . , and an Nth harmonic 23 in association with intensities.

As for characteristics of the fundamental tone 21, the second harmonic 22, and relatively lower-order harmonics (having lower frequencies), each characteristic is expressed as a convex graph, serving as a combination of linear functions. On the other hand, each of characteristics of relatively higher-order harmonics, including the Nth harmonic 23, is expressed as a linear function. In other words, an attenuation against the intensity of a tone depends on the order of a harmonic. Especially regarding the characteristics of the lower-order harmonics, it can be seen that the decreasing rate in attenuation increases as the intensity of a tone decreases.

As for noises, the first and second noise generators 4 and 6 having different characteristics output the signals corresponding to the noise A and the noise B, respectively. The first noise generator 4 generates the noise A which includes up to a high frequency generated by a loud musical performance. The second noise generator 6 generates the noise B which does not include a high frequency generated by a soft musical performance. The noise A output from the first noise generator 4 is supplied to the attenuator 5 and the noise B output from the second noise generator 6 is supplied to the attenuator 7.

Figure 4:
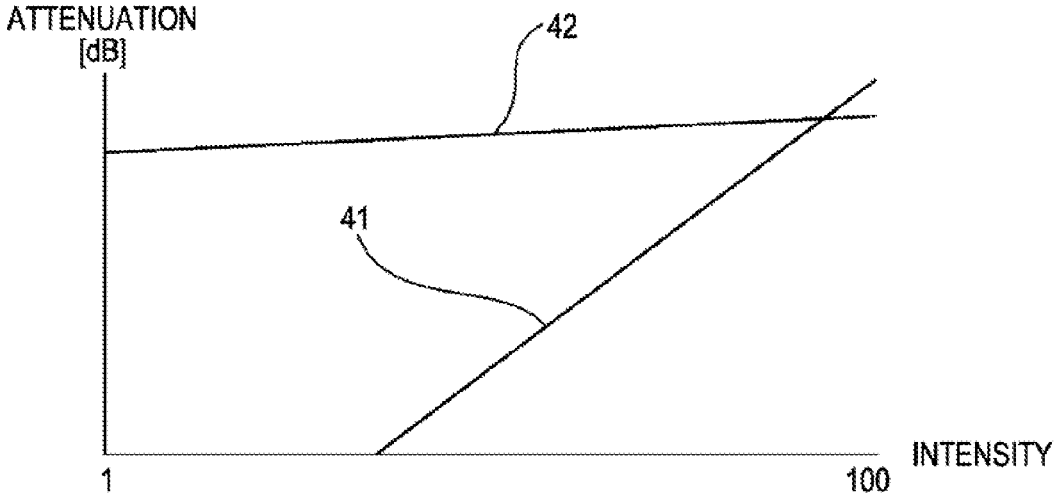
FIG. 4 is a graph showing an example of values in a second attenuation table.

FIG. 4 shows an example of values of the second attenuation table 15.

Attenuations by the attenuator 5 and 7 are stored in the second attenuation table 15 such that the value of attenuation plotted on the ordinate is determined by the intensity plotted on the abscissa as shown in FIG. 4, the intensity being within the range of 1 to 100. Referring to FIG. 4, an attenuation 41 in the noise A by the attenuator 5 is slightly lower than an attenuation 42 in the noise B by the attenuator 7 in a relatively loud musical performance.

As a musical performance is relatively weakened, an attenuation in the noise A by the attenuator 5 remarkably decreases but an attenuation in the noise B by the attenuator 7 gradually changes. Consequently, the amplitudes of generated noise components can be controlled so as to change in accordance with the intensity of a musical performance tone.

Sine waves outputs of the oscillators 2-1 to 2-N and outputs of the first and second noise generators 4 and 6 are supplied to the adder 8 through the attenuators 3-1 to 3-N and the attenuators 5 and 7, respectively. The adder 8 adds those outputs to output a composite one. The attenuator 9 determines the resultant loudness level of the composite tone and outputs the resultant tone as a composite tone 10.

A method of modeling an attenuation in harmonic against the intensity of a musical performance tone to control the attenuation will now be described.

Figure 3:
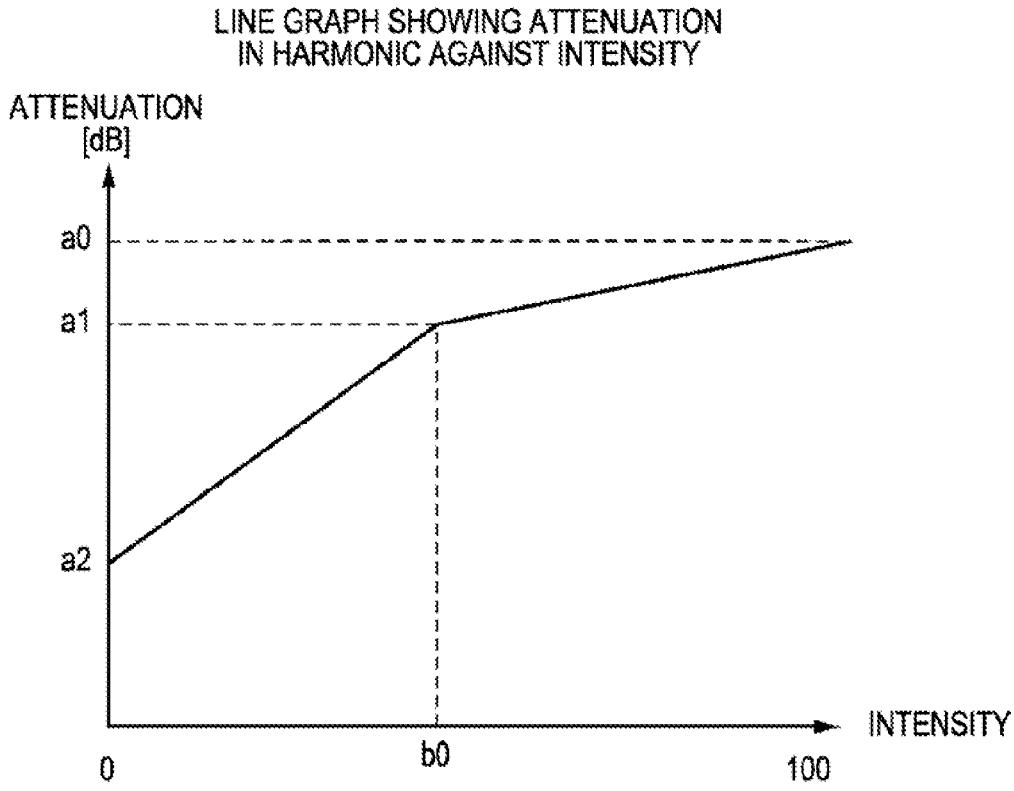
FIG. 3 shows an attenuation in a certain harmonic against the intensity using a line graph.

FIG. 3 shows an attenuation in a certain harmonic against the intensity using a line graph.

Referring to FIG. 3, the line graph shows the attenuation in the harmonic plotted against the intensity of a musical performance tone in the range of 1 to 100. The first attenuation table 14 stores data units a0, a1, a2, and b0. FIG. 3 shows an example of the characteristic of a relatively lower-order harmonic, e.g., the second harmonic 22, or the fundamental tone 21 shown in FIG. 2.

When let X be the intensity and let Y be the attenuation, the controller 12 calculates the attenuation Y using the following Expressions.

When X<b0, $$Y=X*(a1-a2)/b0+a2 \quad \text{Expression 1}$$

When X≧b0, $$Y=(X-b0)*(a0-a1)/100-b0) \quad \text{Expression 2}$$

This model of the line graph showing the attenuation in the certain harmonic plotted against the intensity in FIG. 3 is formed by measuring the properties of real piano tones. Therefore, the controller 12 can hold the data stored in the first attenuation table 14 as a minimum amount of data, calculate another attenuation in the harmonic according to the intensity of a musical performance tone using the minimum amount of data and the above-described Expression 1 or 2, and generate data indicating the calculated attenuation.

In the above-described example, the model of the line graph alone has been described. As for data regarding other linear functions stored in the first attenuation table 14, similarly, a minimum amount of data related to each linear function may be held in the table and the controller 12 may calculate another attenuation using the foregoing Expression 1 or 2 and generate data indicating the calculated attenuation.

A case where oscillators necessary for generation of the necessary number of harmonics are allowed to be usable in accordance with the usages of the oscillators will now be described with an concrete example.

Referring to FIG. 1, the controller 12 includes a table control unit 16 for controlling the usage of each oscillator.

The table control unit 16 has various tables shown in FIGS. 5A to 6C. FIG. 5A shows a first table as an oscillator control table and FIG. 5B shows a second table as a note control table. FIG. 6A shows a third table as a harmonic amplitude table, FIG. 6B shows a fourth table as a harmonic intensity table, and FIG. 6C shows a fifth table as an intensity to attenuation conversion table.

In this case where the oscillators are allowed to be usable in accordance with their usages, the first to fifth tables, i.e., the five tables are used.

Referring to FIG. 5A, the first table serves as the oscillator control table for controlling the usages of the oscillators 2-1 to 2-N. The first table includes M entries, M being the design maximum number of oscillators 2-1 to 2-N.

The first table (oscillator control table) describes oscillator numbers 51 indicating an identification number, usages 52 indicating whether the corresponding oscillator is in use, the notes 53, such as C4 and A2, which frequencies generated by the oscillators 2-1 to 2-N belong to, respectively. Since the amplitude of an output of each of the oscillators 2-1 to 2-N changes according to time, the first table further describes the latest amplitudes 54 of outputs of the respective oscillators.

Referring to FIG. 5B, the second table, serving as the note control table, describes notes 55 from C0 to C8 and durations 56, during each of which a tone of the corresponding note 55 is generated.

Referring to FIG. 6A, the third table, serving as the harmonic amplitude table, describes notes 61, the ordinal numbers 62 of harmonics each of which is necessary for synthesis of the corresponding note 61, and the maximum amplitudes 63 of the respective harmonics.

Referring to FIG. 6B, the fourth table, serving as the harmonic intensity table, describes notes 64, the ordinal numbers 65 of harmonics each of which is necessary for synthesis of the corresponding note 64, the intensities 66 of musical performances, and attenuations 67 each against the corresponding intensity. The intensity 66 is in the range of 1 to 100.

Referring to FIG. 6C, the fifth table, serving as the intensity to attenuation conversion table, describes intensities 68 each indicating the loudness or softness of a musical performance and attenuations 69, each of which is used for attenuation of a composite tone according to the corresponding intensity 68.

Figure 7:
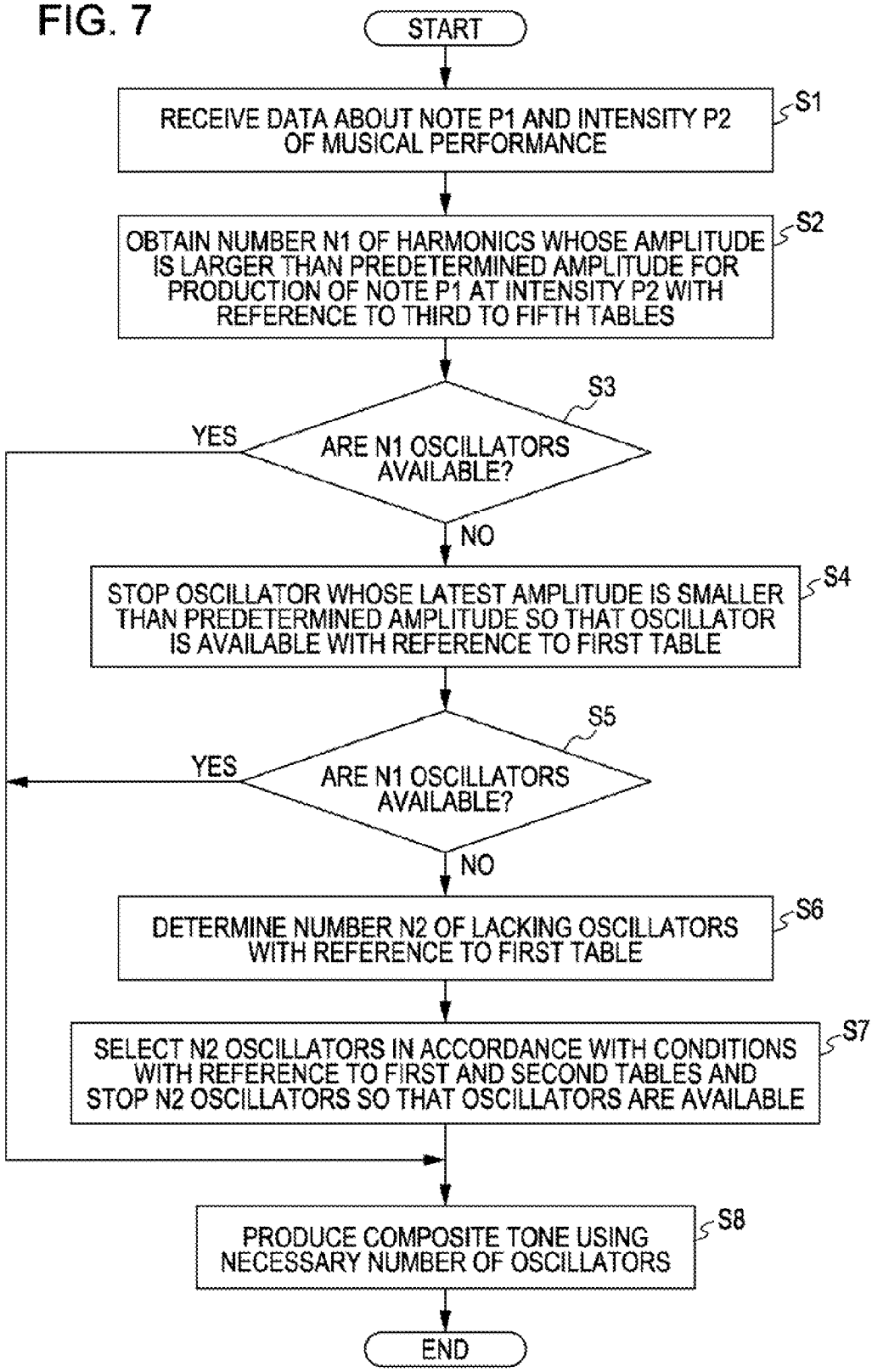
FIG. 7 is a flowchart of a process of stopping an oscillator and controlling the usage of each oscillator.
Figure 8:
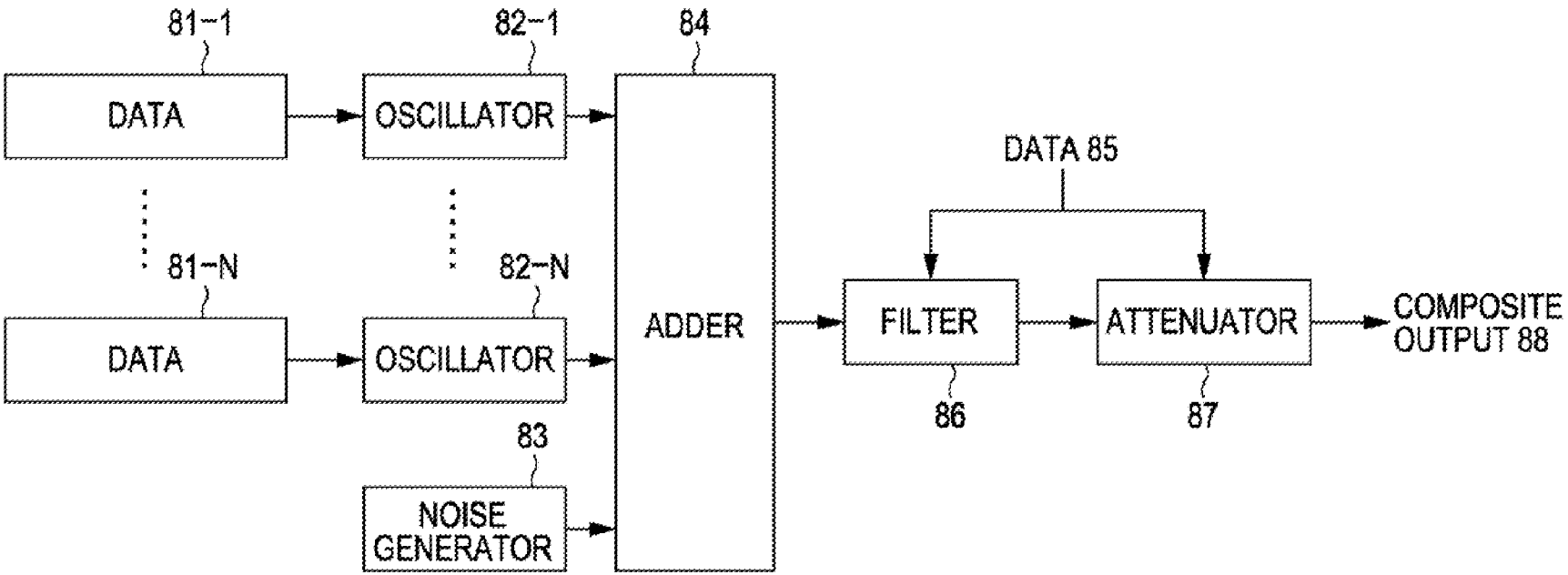
FIG. 8 is a block diagram of a known piano source apparatus.

In the case where the oscillators are allowed to be usable in accordance with the usages, the controller 12 performs a process in accordance with a flowchart shown in FIG. 7 using the above-described first to fifth tables while transmitting and receiving data to/from the table control unit 16.

FIG. 7 shows the flowchart of a process of stopping an oscillator and controlling the usage thereof. The flowchart represents the operation of the computer, serving as the controller 12, in accordance with the piano sound synthesis program. According to the program, the compound is allowed to add a piano sound source providing a plurality of sinusoidal oscillation frequencies generated by the oscillators 2-1 to 2-N and a noise source providing a plurality of noise oscillation frequencies generated by the first and second noise generators 4 and 6 to output a composite tone.

Referring to FIG. 7, data about a note P1 of a musical performance and data about the intensity P2 thereof are received (step S1). Specifically, the controller 12 receives the data about the note P1 corresponding to the note 64 and data about the intensity P2 corresponding to the intensity 66 from the fourth table, serving as the harmonic intensity table, of FIG. 6B.

Subsequently, the number N1 of harmonics whose amplitude is larger than a predetermined amplitude for production of the note P1 at the intensity P2 is obtained from the third to fifth tables (step S2). Specifically, the controller 12 receives the data about the note P1 and the data about the intensity P2 from the table control unit 16 and obtains the final maximum amplitude of each of harmonics included in the note P1 by adding the maximum amplitude 63 in the third table (harmonic amplitude table) of FIG. 6A, the attenuation 67 in the fourth table (harmonic intensity table) of FIG. 6B, and the attenuation 69 in the fifth table (intensity to attenuation conversion table) of FIG. 6C. When the maximum amplitude obtained on the basis of the note P1 and the intensity P2 indicated by the received data is smaller than, for example, −100 [dB], the controller 12 determines that it is unnecessary to allow an oscillator to be usable and also determines the number N1 of oscillators actually needed.

In this instance, whether the number N1 of oscillators actually needed are available is determined with reference to the first table (step S3). Specifically, the controller 12 checks the usages 52 in the first table (oscillator control table) of FIG. 5A to determine whether the necessary number N1 of oscillator are usable. If it is determined in step S3 that the necessary number N1 of oscillators are not in use, namely, they are usable, the process proceeds to an actual tone producing step, thus generating a composite tone using the necessary number of oscillators (step S8).

If it is determined in step S3 that the necessary number N1 of oscillator are not usable, an oscillator whose latest amplitude is smaller than a predetermined amplitude is stopped so that the oscillator is usable on the basis of the first table (step S4). Specifically, the controller 12 refers to the first table (oscillator control table) of FIG. 5A and stops the oscillating operation of an oscillator whose latest amplitude 54 is smaller than the predetermined amplitude, for example, −100 [dB] so that the oscillator is usable for production of a harmonic to which another frequency belongs.

In this instance, whether the necessary number N1 of oscillators are usable is determined with reference to the first table (step S5). Specifically, the controller 12 again refers to the usages 52 in the first table (oscillator control table) of FIG. 5A and determines whether the necessary number N1 of oscillators are usable. If it is determined in step S5 that the necessary number N1 of oscillators are usable, the process proceeds to step S8.

If it is determined in step S5 that the necessary number of N1 oscillators are not usable, the number N2 of lacking oscillators is determined with reference to the first table (step S6). Specifically, the controller 12 refers to the usages 52 in the first table (oscillation control table) of FIG. 5A and determines the number n2 of lacking oscillators.

N2 oscillators are selected with reference to the first table in accordance with the following criteria: "the latest amplitude is small", "the duration is long", and "the latest frequency is high", these criteria being arranged in the order of decreasing priorities. After that, the selected oscillators are stopped so that they are usable (step S7). Specifically, the controller 12 selects N2 oscillators on the basis of the latest amplitude 54 in the first table (oscillator control table) of FIG. 5A, the duration 56 in the second table (note control table) of FIG. 5B, the note 53 in the first table, and the note 55 in the second table.

The controller 12 selects N2 oscillators on the basis of those selection criteria, i.e., "the latest amplitude is small", "the duration of the note is long", and "the latest frequency is high" arranged in the order of decreasing priorities and stops the oscillating operation of each selected oscillator. In other words, the controller 12 ensures the oscillators necessary for production of harmonics to which other frequencies belong. The process proceeds to step S8.

It should be understood by those skilled in the art that various modifications, combinations, sub-combinations and alterations may occur depending on design requirements and other factors insofar as they are within the scope of the appended claims or the equivalents thereof.

What is claimed is:

1. A piano sound source apparatus for adding a piano sound source providing a plurality of sinusoidal oscillation frequencies and a noise source providing a plurality of noise oscillation frequencies to output a composite tone, comprising:

oscillation control means for controlling the frequency and amplitude of each of sine waves corresponding to the sinusoidal oscillation frequencies on the basis of time;

amplitude control means for controlling the amplitude of each of the sine waves corresponding to the sinusoidal oscillation frequencies in accordance with the intensity of the composite tone; and mixing-proportion control means for controlling the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

2. The apparatus according to claim 1, wherein the amplitude control means uses a characteristic of a fundamental tone and those of a plurality of harmonics, each characteristic being a change in attenuation of the amplitude of the corresponding sine wave according to the intensity of the composite tone, the characteristics being different from one another.

3. The apparatus according to claim 1, wherein the mixing-proportion control means uses a characteristic of each of the noise oscillation frequencies, each characteristic being a change in attenuation of the amplitude of the corresponding noise oscillation frequency according to the intensity of the composite tone, the characteristics being different from each other.

4. The apparatus according to claim 1, further comprising:

oscillating-state control means for controlling the usages of sine wave oscillators for generation of the sine waves corresponding to the sinusoidal oscillation frequencies;

oscillator control means for determining the number of sine wave oscillators for generation of the sine waves corresponding to the sinusoidal oscillation frequencies necessary for output of the composite tone; and stop determination means for selecting a sine wave oscillator that is allowed to stop from the sine wave oscillators in use on the basis of the usages of the sine wave oscillators.

5. A piano sound synthesis method of adding a piano sound source providing a plurality of sinusoidal oscillation frequencies and a noise source providing a plurality of noise oscillation frequencies to output a composite tone, the method comprising the steps of:

controlling the frequency and amplitude of each of sine waves corresponding to the sinusoidal oscillation frequencies on the basis of time;

controlling the amplitude of each of the sine waves corresponding to the sinusoidal oscillation frequencies in accordance with the intensity of the composite tone; and controlling the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

6. The method according to claim 5, further comprising the steps of:

controlling the usages of sine wave oscillators for generation of the sine waves corresponding to the sinusoidal oscillation frequencies;

determining the number of sine wave oscillators for generation of the sine waves corresponding to the sinusoidal oscillation frequencies necessary for output of the composite tone; and selecting a sine wave oscillator that is allowed to stop form the sine wave oscillators in use on the basis of the usages of the sine wave oscillators.

7. A piano sound synthesis program that allows a computer to add a piano sound source providing a plurality of sinusoidal oscillation frequencies and a noise source providing a plurality of noise oscillation frequencies to output a composite tone, the program comprising:

an oscillation control function of controlling the frequency and amplitude of each of sine waves corresponding to the sinusoidal oscillation frequencies on the basis of time;

an amplitude control function of controlling the amplitude of each of the sine waves corresponding to the sinusoidal oscillation frequencies in accordance with the intensity of the composite tone; and a mixing-proportion control function of controlling the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

8. The program according to claim 7, further comprising:

an oscillating-state control function of controlling the usages of sine wave oscillators for generation of the sine waves corresponding to the sinusoidal oscillation frequencies;

an oscillator control function of determining the number of sine wave oscillators for generation of the since waves corresponding to the sinusoidal oscillation frequencies necessary for output of the composite tone; and a stop determination function of selecting a sine wave oscillator that is allowed to stop from the sine wave oscillators in use on the basis of the usages of the sine wave oscillators.

9. A piano sound source apparatus for adding a piano sound source providing a plurality of sinusoidal oscillation frequencies and a noise source providing a plurality of noise oscillation frequencies to output a composite tone, comprising:

an oscillation control unit that controls the frequency and amplitude of each of sine waves corresponding to the sinusoidal oscillation frequencies on the basis of time;

an amplitude control unit that controls the amplitude of each of the sine waves corresponding to the sinusoidal oscillation frequencies in accordance with the intensity of the composite tone; and a mixing-proportion control unit that controls the amplitude of each of the noise oscillation frequencies in accordance with the intensity of the composite tone to control the mixing proportion of the amplitudes of the noise oscillation frequencies and those of the sine waves corresponding to the sinusoidal oscillation frequencies.

* * * * *